US009244429B2

(12) United States Patent
Okabe

(10) Patent No.: US 9,244,429 B2
(45) Date of Patent: Jan. 26, 2016

(54) IMAGE FORMING APPARATUS HAVING SUPPORTING MEMBER FOR SUPPORTING CARTRIDGES

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,289

(22) Filed: Mar. 28, 2014

(65) Prior Publication Data

US 2014/0294438 A1 Oct. 2, 2014

(30) Foreign Application Priority Data

Mar. 29, 2013 (JP) ..... 2013-072076

(51) Int. Cl.

| | |
|---|---|
| ***G03G 15/00*** | (2006.01) |
| ***G03G 21/18*** | (2006.01) |
| ***G03G 21/16*** | (2006.01) |
| *G03G 15/01* | (2006.01) |

(52) U.S. Cl.

CPC ..... *G03G 21/1842* (2013.01); *G03G 21/1619* (2013.01); *G03G 15/0194* (2013.01); *G03G 2215/0141* (2013.01); *G03G 2221/1684* (2013.01)

(58) Field of Classification Search

CPC ..... G03G 15/0194; G03G 21/1839; G03G 21/1842; G03G 2221/1684

USPC ..... 399/111, 299

See application file for complete search history.

(56) References Cited

U.S. PATENT DOCUMENTS

| | | | | |
|---|---|---|---|---|
| 8,583,006 | B2 | 11/2013 | Murayama et al. | |
| 2007/0036581 | A1 * | 2/2007 | Okabe | 399/111 |
| 2008/0159773 | A1 | 7/2008 | Murayama et al. | |
| 2009/0092412 | A1 * | 4/2009 | Kei | 399/110 |
| 2010/0111562 | A1 * | 5/2010 | Okabe et al. | 399/112 |
| 2011/0299878 | A1 * | 12/2011 | Kamimura | 399/110 |
| 2012/0177403 | A1 | 7/2012 | Murayama et al. | |
| 2014/0294437 | A1 * | 10/2014 | Okabe | 399/110 |

FOREIGN PATENT DOCUMENTS

JP 2008-165025 A 7/2008

* cited by examiner

*Primary Examiner* — Benjamin Schmitt

(74) *Attorney, Agent, or Firm* — Banner & Witcoff, Ltd.

(57) ABSTRACT

An image forming apparatus includes: a main casing; a plurality of cartridges each extending in a first direction substantially perpendicular to a vertical direction; and a supporting member configured to detachably support the plurality of cartridges such that the cartridges are arrayed in a second direction substantially perpendicular to the vertical direction and the first direction. The supporting member is movable between an inner position disposed within the main casing and an outer position disposed outside of the main casing. The supporting member includes: a first side plate; a second side plate positioned opposite to and spaced away from the first side plate in the first direction; and a prescribed number of beam plate connecting between the first side plate and the second side plate, the prescribed number being in a range of from one to not more than a number of the cartridges.

19 Claims, 9 Drawing Sheets

IMAGE FORMING APPARATUS HAVING SUPPORTING MEMBER FOR SUPPORTING CARTRIDGES

CROSS REFERENCE TO RELATED APPLICATION

This application claims priority from Japanese Patent Application No. 2013-072076 filed Mar. 29, 2013. The entire content of the priority application is incorporated herein by reference.

TECHNICAL FIELD

The present invention relates to an electro-photographic image forming apparatus.

BACKGROUND

A known tandem-type color printer includes a main body and a plurality of cartridges detachably mountable in the main body.

One of such conventional color printers includes a main body and a cartridge tray configured to be held in the main body so as to be slidable relative to the main body. In this color printer, the cartridge tray supports therein a plurality of cartridges juxtaposed to one another (see Japanese Patent Application Publication No. 2008-165025).

SUMMARY

It is an object of the present invention to provide an improved image forming apparatus.

In order to attain the above and other objects, there is provided an image forming apparatus including: a main casing; a plurality of cartridges; and a supporting member. Each of the plurality of cartridges extends in a first direction substantially perpendicular to a vertical direction and accommodates developer. The supporting member is configured to detachably support the plurality of cartridges such that the cartridges are arrayed in a second direction substantially perpendicular to the vertical direction and the first direction, the supporting member being movable between an inner position disposed within the main casing and an outer position disposed outside of the main casing. The supporting member includes a first side plate, a second side plate, and a prescribed number of beam plate. The second side plate is positioned opposite the first side plate to be spaced away therefrom in the first direction. The prescribed number of beam plate connects between the first side plate and the second side plate, the prescribed number being in a range of from one to not more than a number of the cartridges.

According to another aspect of the present invention, there is provided an image forming apparatus including a main casing, a drawer and a plurality of cartridges. The drawer is movable in a first direction between an inner position disposed within the main casing and an outer position disposed outside of the main casing. Each of the plurality of cartridges accommodates developer therein and is configured to be detachable and attachable relative to the drawer. The drawer includes a first side wall, a second side wall and a prescribed number of beam plate. The second side wall is disposed at a position opposite to the first side wall with respect to the plurality of cartridges in a second direction perpendicular to the first direction. The prescribed number of beam plate connects between the first side plate and the second side plate, the prescribed number being in a range of from one to not more than a number of the cartridges.

DETAILED DESCRIPTION

1. General Structure of the Printer

Figure 1:
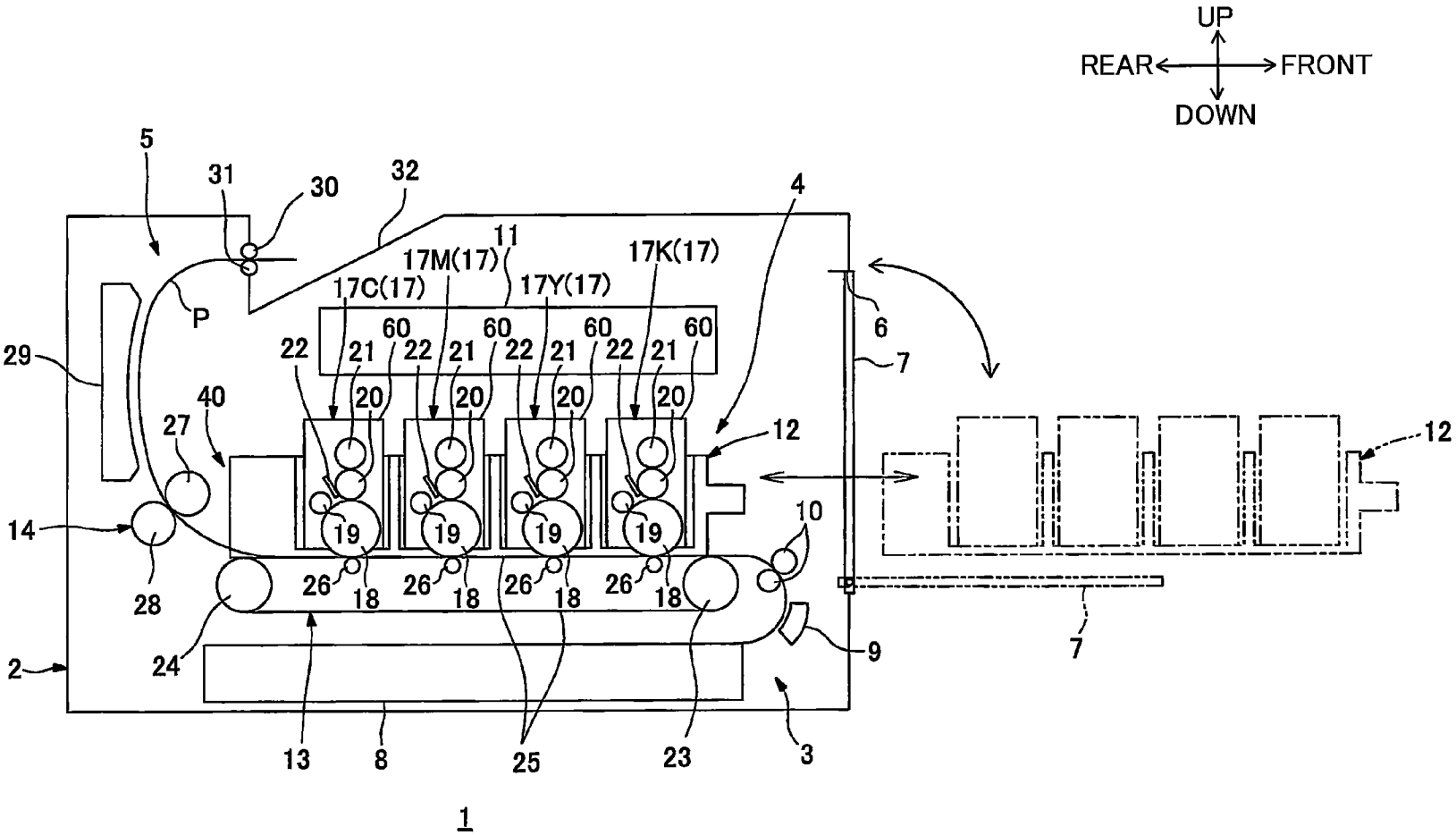
FIG. 1 is a schematic central cross-sectional view illustrating a general configuration of a printer according to a first embodiment of the present invention, the printer slidably accommodating a drawer unit according to the first embodiment supporting a plurality of process cartridges.

A printer 1 is a horizontal direct tandem-type color laser printer, as shown in FIG. 1. The printer 1 is an example of an image forming apparatus according to a first embodiment of the present invention.

First, a general structure of the printer 1 will be described with reference to FIG. 1.

Throughout the specification, the terms "above", "below", "right", "left", "front", "rear" and the like will be used assuming that the printer 1 is resting on a level surface. More specifically, in FIG. 1, a right side, a left side, a near side and a far side will be referred to as a front side, a rear side, a left side and a right side of the printer 1, respectively.

(1) Main Casing

The main casing 2 has a substantially rectangular box shape in a side view. The main casing 2 has a front wall formed with a main body opening 6, and a front cover 7. The front cover 7 is configured to be pivotally movable about a lower end portion thereof between a closing position closing the main body opening 6 (show by a solid line in FIG. 1) and an opening position opening the main body opening 6 (shown by a dotted line in FIG. 1). The main casing 2 houses therein a sheet supply section 3 and an image forming section 4.

(2) Sheet Supply Section

The sheet supply section 3 has a sheet cassette 8, a sheet supply guide 9 and a pair of registration rollers 10. The sheet cassette 8 serves to accommodate sheets of paper P therein. The sheet cassette 8 is detachably attached to a bottom portion of the main casing 2.

The sheets P stacked in the sheet cassette 8 are fed one by one, and directed upward and rearward toward between the pair of registration rollers 10 while being guided along a U-shaped path by the sheet guide 9, and then conveyed at a prescribed timing toward between a photosensitive drum 18 (described later) and a conveying belt 25 (described later) of the image forming section 4.

(3) Image Forming Section

The image forming section 4 includes a scanner unit 11, a drawer unit 12, a transfer unit 13, and a fixing unit 14.

(3-1) Scanner Unit

The scanner unit 11 is disposed at an upper portion of the main casing 2. The scanner unit 11 emits a laser beam to each of a plurality of photosensitive drums 18 (described later) based on image data to expose the corresponding photosensitive drum 18 to light.

(3-2) Drawer Unit

The drawer unit 12 is disposed at a position generally center of the main casing 2 in an up-down direction and below the scanner unit 11.

The drawer unit 12 includes a drawer frame 40 and four process cartridges 17 corresponding to respective four colors used in the printer 1. The four process cartridges 17 are attachable to and detachable from the drawer frame 40.

The drawer unit 12 is configured to move in a front-rear direction between an inner position (denoted by a solid line) at which the drawer unit 12 is positioned inside the main casing 2 and an outer position (denoted by an imaginary line) at which the drawer unit 12 is positioned outside the main casing 2.

The four process cartridges 17 are arranged spaced apart from one another in the front-rear direction in the drawer frame 40. The process cartridges 17 include a black process cartridge 17K, a yellow process cartridge 17Y, a magenta process cartridge 17M, and a cyan process cartridge 17C arranged in the drawer frame 40 in the mentioned order from the front to the rear.

Each of the four process cartridges 17 has the photosensitive drum 18, a charging roller 19, a developing roller 20, a supply roller 21, and a thickness regulation blade 22.

The photosensitive drum 18 has a substantially cylindrical shape extending in a left-right direction. The photosensitive drum 18 is rotatably supported by a lower end portion of the process cartridge 17. A lower end portion of the photosensitive drum 18 is exposed downward from the process cartridge 17.

The charging roller 19 has a substantially columnar shape extending in the left-right direction. The charging roller 19 is rotatably supported in the process cartridge 17 to be in contact with an upper rear portion of the photosensitive drum 18.

The developing roller 20 has a substantially columnar shape extending in the left-right direction. The developing roller 20 is rotatably supported in the process cartridge 17 to be in contact with an upper portion of the photosensitive drum 18.

The supply roller 21 has a substantially columnar shape extending in the left-right direction. The supply roller 21 is rotatably supported in the process cartridge 17 to be in contact with an upper portion of the developing roller 20.

The thickness regulation blade 22 is rotatably supported in the process cartridge 17 to be in contact with a rear portion of the developing roller 20.

Each process cartridge 17 houses toner of one of respective colors.

The toner in the process cartridge 17 is supplied to the supply roller 21, then to the developing roller 20. At this time, the toner is tribo-charged with a positive polarity between the supply roller 21 and developing roller 20.

Then, as the developing roller 20 rotates, the toner on the developing roller 20 is regulated by the thickness regulation blade 22 and carried as a thin toner layer of a uniform thickness on a surface of the developing roller 20.

In the meantime, a surface of the photosensitive drum 18 is uniformly and positively charged by the charging roller 19 as the photosensitive drum 18 rotates. Then, the scanner unit 11 emits a laser beam to the charged surface of the photosensitive drum 18 to expose the surface of the photosensitive drum 18 to light. As a result, an electrostatic latent image corresponding to an image to be formed on the sheet P is formed on the surface of the photosensitive drum 18.

As the photosensitive drum 18 further rotates, the toner carried on the surface of the developing roller 20 and having a positive polarity is supplied to the electrostatic latent image formed on the surface of the photosensitive drum 18. In this way, a toner image is formed on the surface of the photosensitive drum 18 through a reversal phenomenon.

(3-3) Transfer Unit

In the main casing 2, the transfer unit 13 is disposed above the sheet supply section 3 but below the drawer unit 12 within the main casing 2. The transfer unit 13 extends in the front-rear direction.

The transfer unit 13 includes a drive roller 23, a driven roller 24, the conveying belt 25, and four transfer rollers 26.

The drive roller 23 and driven roller 24 are arranged to be spaced apart from each other in the front-rear direction. The conveying belt 25 is mounted on and around the drive roller 23 and driven roller 24 in a tout state. Each of the four transfer rollers 26 is disposed to correspond to the corresponding one of the four photosensitive drums 18 such that an upper portion of the conveying belt 25 is interposed between each of the pairs of the transfer roller 26 and the photosensitive drum 18. Each pair of the transfer roller 26 and the photosensitive drum 18 defines a transfer position therebetween on the conveying belt 25.

The sheet P supplied from the sheet supply section 3 is conveyed by the conveying belt 25 conveys from the front side to rear side to sequentially passes through the four transfer positions. During passage of the sheet P through the transfer positions, the toner images of the respective colors carried on the respective photosensitive drums 18 are sequentially superimposed onto the sheet P to form a color image thereon.

(3-4) Fixing Unit

The fixing unit 14 is disposed rearward of the transfer unit 13. The fixing unit 14 includes a heating roller 29 and a pressure roller 30. The pressure roller 30 is disposed adjacent to the heating roller 29 to be positioned at a lower rear side of the heating roller 29.

As the sheet P passes between the heating roller 29 and pressure roller 30, the toner image transferred onto the sheet P is thermally fixed thereon due to application of heat and pressure by the heating roller 29 and pressure roller 30.

(4) Sheet Discharge Section

The sheet discharge section 5 is disposed above the fixing unit 14. The sheet discharge section 5 includes a discharge guide 29, a discharge port 30, a pair of discharge rollers 31, and a discharge tray 32.

The sheet P on which the toner image has been thermally fixed in the fixing unit 14 is fed upward and frontward while making a U-turn with a guide by the discharge guide 29. The sheet P then passes between the pair of discharge rollers 31, and is finally discharged onto the discharge tray 32 through the discharge port 30.

2. Drawer Unit of the First Embodiment

The drawer unit 12 of the first embodiment includes the drawer frame 40 and the four process cartridges 17 detachably accommodated in the drawer frame 40.

(1) Drawer Frame

The drawer frame 40 is configured to support the four process cartridges 17 arranged in the front-rear direction. Further, the drawer frame 40 is configured to be slidable in the front-rear direction relative to the main casing 2. Specifically, the drawer frame 40 supporting the process cartridges 17 is capable of moving between the inner position at which the drawer unit 12 is attached to the main casing 2 and the outer position at which the drawer unit 12 is detached from the main casing 2 as described above.

Figure 2:
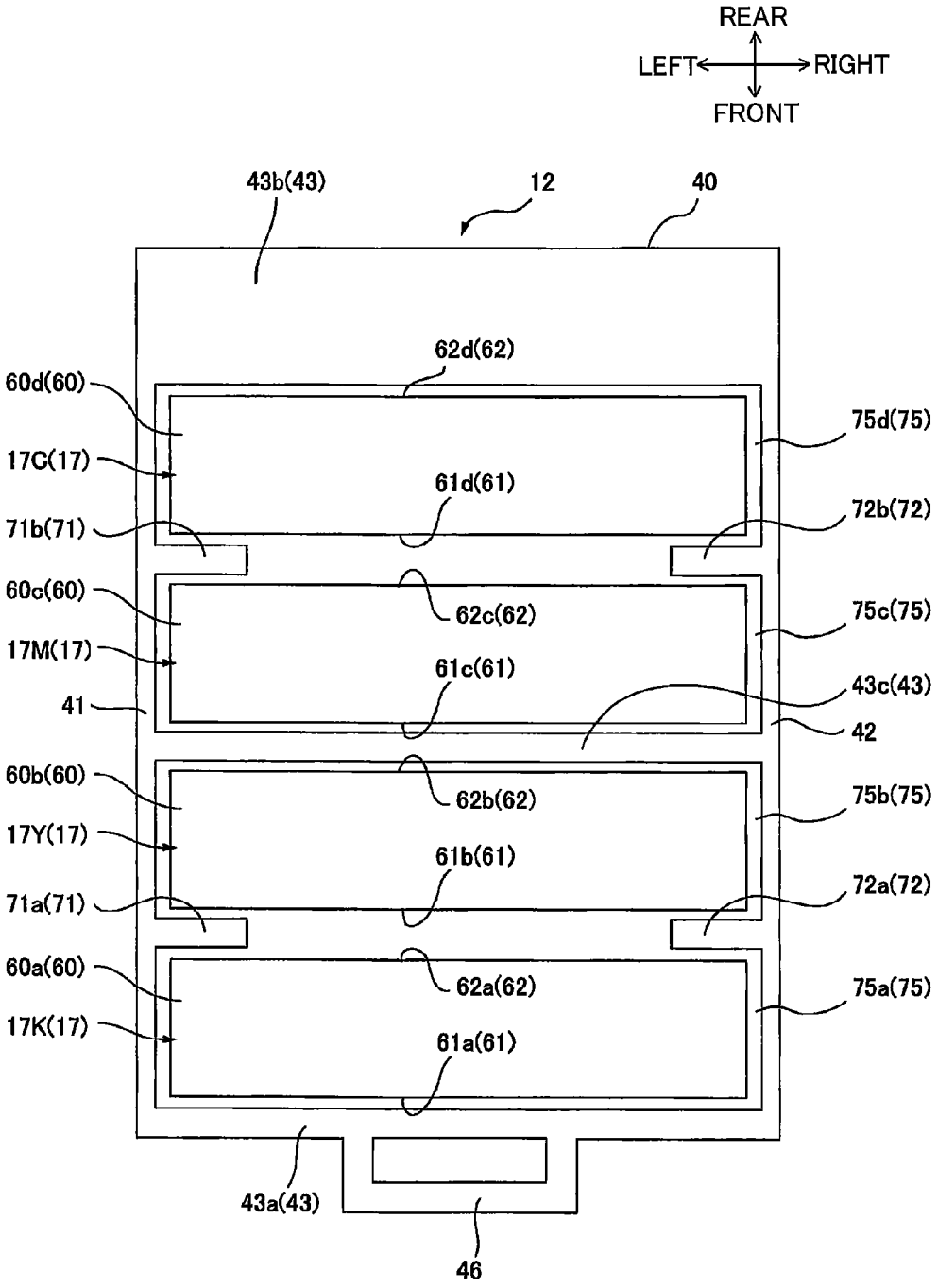
FIG. 2 is a plan view of the drawer unit according to the first embodiment, the drawer unit including a front beam, a center beam and a rear beam.

As illustrated in FIG. 2, the drawer frame 40 includes a left side plate 41 and a right side plate 42 arranged to be spaced away from each other in the left-right direction, and three beam plates 43 connecting between the left side plate 41 and the right side plate 42. The left side plate 41 and right side plate 42 extend in the front-rear direction.

The left side plate 41 is substantially rectangular flat plate shaped in a side view. Although not illustrated, the left side plate 41 has a bottom end portion that is bent rightward. The left side plate 41 thus has a substantially L-like shape in a front view. Further, the left side plate 41 has a right side surface from which two left protruding plates 71 protrude rightward up to a position midway between the left side plate 41 and right side plate 42 in the left-right direction. Each left protruding plate 71 has substantially a rectangular flat plate in a front view. Each left protruding plate 71 has a right end portion (protruding end) that is positioned leftward of a center between the left side plate 41 and right side plate 42 in the left-right direction. The left protruding plates 71 are configured of a front-left intermediate protruding plate 71*a* and a rear-left intermediate protruding plate 71*b*.

The front-left intermediate protruding plate 71*a* protrudes rightward from the right side surface of the left side plate 41 and is positioned at an intermediate position between the front end portion and center portion of the left side plate 41 in the front-rear direction (front intermediate position of the left side plate 41).

The rear-left intermediate protruding plate 71*b* protrudes rightward from the right side surface of the left side plate 41 and is positioned at an intermediate position between the rear end portion and center portion of the left side plate 41 in the front-rear direction (rear intermediate position of the left side plate 41).

The right side plate 42 is substantially a rectangular flat plate in a side view. Although not illustrated, the right side plate 42 has a bottom end portion that is bent leftward. The right side plate 42 thus has a substantially L-like shape in a front view. The right side plate 42 has a left side surface from which two right protruding plates 72 protrude leftward up to a position midway between the left side plate 41 and right side plate 42 in the left-right direction. Each right protruding plate 72 has substantially a rectangular flat plate in a front view. Each right protruding plate 72 has a left end portion (protruding end) that is positioned rightward of the center between the left side plate 41 and right side plate 42 in the left-right direction. The right protruding plate 72 are configured of a front-right intermediate protruding plate 72*a* and a rear-right intermediate protruding plate 72*b*.

The front-right intermediate protruding plate 72*a* protrudes leftward from the left side surface of the right side plate 42 and is positioned at an intermediate position between the front end portion and center portion of the right side plate 42 in the front-rear direction (front intermediate position of the right side plate 42).

The rear-right intermediate protruding plate 72*b* protrudes leftward from the left side surface of the right side plate 42 and is positioned at an intermediate position between the rear end portion and center portion of the right side plate 42 in the front-rear direction (the rear intermediate position of the right side plate 42).

The front-left intermediate protruding plate 71*a* and front-right intermediate protruding plate 72*a* are aligned with each other with respect to the left-right direction. Similarly, the rear-left intermediate protruding plate 71*b* and rear-right intermediate protruding plate 72*b* are aligned with each other with respect to the left-right direction.

The left side plate 41 and right side plate 42 are formed of the same resin material (e.g., ABS) and have the same linear expansion coefficient as each other (e.g., $80\times10^{-6}/°$ C.).

The three beam plates 43 include a front beam 43*a*, a rear beam 43*b*, and a center beam 43*c*. The beam plates 43 are formed of the same resin material and have the same linear expansion coefficient as one another. Further, the beam plates 43 are formed of the same resin material as those of the left side plate 41 and right side plate 42 and have the same linear expansion coefficient as those of the left side plate 41 and right side plate 42.

The front beam 43*a* is a flat plate having a substantially rectangular shape extending in the left-right direction in a front view. The front beam 43*a* connects the front end portion of the left side plate 41 and front end portion of the right side plate 42. The front beam 43*a* has a front surface and a gripping part 46 protrudes frontward from the front surface at a center thereof in the left-right direction.

The rear beam 43*b* has substantially a rectangular shape in a front view and extends in the left-right direction. The rear beam 43*b* has a thickness larger than that of the front beam 43*a* in the front-rear direction. The rear beam 43*b* connects the rear end portion of the left side plate 41 and rear end portion of the right side plate 42.

The center beam 43*c* is a flat plate having a substantially rectangular shape extending in the left-right direction in a front view. The center beam 43*c* connects the center portion of the left side plate 41 and center portion of the right side plate 42 and is positioned at a center between the front beam 43*a* and rear beam 43*b* in the front-rear direction.

The left side plate 41, right side plate 42, three beam plates 43, left protruding plates 71, and right protruding plates 72 define four cartridge housing spaces 75.

Specifically, the front beam 43*a*, front-left and front-right intermediate protruding plates 71*a* and 72*a*, and left and right side plates 41 and 42 between the front beam 43*a* and front-left and front-right intermediate protruding plates 71*a* and 72*a* define a first cartridge housing space 75*a* extending in the left-right direction. The first cartridge housing space 75*a* is located frontmost in the front-rear direction among the four cartridge housing spaces 75.

The center beam 43*c*, front-left and front-right intermediate protruding plates 71*a* and 72*a*, and left and right side plates 41 and 42 between the center beam 43*c* and front-left and front-right intermediate protruding plates 71*a* and 72*a* define a second cartridge housing space 75*b* extending in the left-right direction. The second cartridge housing space 75*b* is positioned to be the second from the front in the front-rear direction among the four cartridge housing spaces 75.

The center beam 43*c*, rear-left and rear-right intermediate protruding plates 71*b* and 72*b*, and left and right side plates 41 and 42 between the center beam 43*c* and rear-left and rear-right intermediate protruding plates 71*b* and 72*b* define a third cartridge housing space 75*c* extending in the left-right direction. The third cartridge housing space 75*c* is positioned to be the second from the rear in the front-rear direction among the four cartridge housing spaces 75.

The rear beam 43*b*, rear-left and rear-right intermediate protruding plates 71*b* and 72*b*, and left and right side plates 41 and 42 between the center beam 43*c* and rear-left and rear-right intermediate protruding plates 71*b* and 72*b* define a fourth cartridge housing space 75*d* extending in the left-right direction. The fourth cartridge housing space 75*d* is positioned rearmost in the front-rear direction among the four cartridge housing spaces 75.

(2) Process Cartridge

Each process cartridge 17 includes a cartridge frame 60.

As illustrated in FIG. 1, the cartridge frame 60 has a substantially box-like shape extending in the left-right direction and having a lower end portion that is open downward. The cartridge frame 60 supports the photosensitive drum 18, charging roller 19, developing roller 20, supply roller 21, and thickness regulation blade 22.

The cartridge frame 60 has a front side surface 61 and a rear side surface 62 both extending in the left-right direction. The front side surface 61 and the rear side surface 62 constitute a front end and a rear end of the cartridge frame 60 respectively.

When the process cartridges 17 are respectively accommodated in the corresponding cartridge housing spaces 75, the lower end portions of the left and right side plates 41 and 42 (the lower ends protruding inward in the left-right direction) support the cartridge frames 60. As a result, the process cartridges 17 are supported in the drawer frame 40.

The black process cartridge 17K, yellow process cartridge 17Y, magenta process cartridge 17M and cyan process cartridge 17C are respectively housed in the first cartridge housing space 75*a*, second cartridge housing space 75*b*, third cartridge housing space 75*c* and fourth cartridge housing space 75*d*. The black process cartridge 17K has a cartridge frame 60*a* with a front side surface 61*a* and a rear side surface 62*a*. The yellow process cartridge 17Y has a cartridge frame 60*b* with a front side surface 61*b* and a rear side surface 62*b*. The magenta process cartridge 17M has a cartridge frame 60*c* with a front side surface 61*c* and a rear side surface 62*c*. The cyan process cartridge 17C has a cartridge frame 60*d* with a front side surface 61*d* and a rear side surface 62*d*.

When the black process cartridge 17K is housed in the first cartridge housing space 75*a*, the front beam 43*a* is positioned frontward of the front side surface 61*a* of the cartridge frame 60*a* of the black process cartridge 17K to be spaced away therefrom in the front-rear direction. The front-left intermediate protruding plate 71*a* and front-right intermediate protruding plate 72*a* are positioned rearward of the rear side surface 62*a* of the cartridge frame 60*a* so as to be spaced apart therefrom in the front-rear direction.

Incidentally, when the black process cartridge 17K is attached to and detached from the first cartridge housing space 75*a*, the rear side surface 62*a* of the black process cartridge 17K is guided by the front-left intermediate protruding plate 71*a* and front-right intermediate protruding plate 72*a*.

When the yellow process cartridge 17Y is housed in the second cartridge housing space 75*b*, the center beam 43*c* is positioned rearward of the rear side surface 62*b* of the cartridge frame 60*b* of the yellow process cartridge 17Y to be spaced away therefrom in the front-rear direction. The front-left intermediate protruding plate 71*a* and front-right intermediate protruding plate 72*a* are positioned frontward of the front side surface 61*b* of the cartridge frame 60*b* so as to be spaced apart therefrom in the front-rear direction.

Incidentally, when the yellow process cartridge 17Y is attached to and detached from the second cartridge housing space 75*b*, the front side surface 61*b* of the yellow process cartridge 17Y is guided by the front-left intermediate protruding plate 71*a* and front-right intermediate protruding plate 72*a*.

When the magenta process cartridge 17M is housed in the third cartridge housing space 75*c*, the center beam 43*c* is positioned frontward of the front side surface 61*c* of the cartridge frame 60*c* of the magenta process cartridge 17M to be spaced away therefrom in the front-rear direction. The rear-left intermediate protruding plate 71*b* and rear-right intermediate protruding plate 72*b* are positioned rearward of the rear side surface 62*c* of the cartridge frame 60*c* so as to be spaced apart therefrom in the front-rear direction.

Incidentally, when the magenta process cartridge 17M is attached to and detached from the third cartridge housing space 75*c*, the rear side surface 62*c* of the magenta process cartridge 17M is guided by the rear-left intermediate protruding plate 71*b* and rear-right intermediate protruding plate 72*b*.

When the cyan process cartridge 17C is housed in the fourth cartridge housing space 75*d*, the rear beam 43*b* is positioned rearward of the rear side surface 62*d* of the cartridge frame 60*d* of the cyan process cartridge 17C to be spaced away therefrom in the front-rear direction. The rear-left intermediate protruding plate 71*b* and rear-right intermediate protruding plate 72*b* are positioned frontward of the front side surface 61*d* of the cartridge frame 60*d* so as to be spaced apart therefrom in the front-rear direction.

Incidentally, when the cyan process cartridge 17C is attached to and detached from the fourth cartridge housing space 75*d*, the front side surface 61*d* of the cyan process cartridge 17C is guided by the rear-left intermediate protruding plate 71*b* and rear-right intermediate protruding plate 72*b*.

When the process cartridges 17 are housed in the cartridge housing spaces 75, respectively, a number of the beam plates 43 is equal to or smaller than a number of the process cartridges 17. Specifically, in the first embodiment, the number of beam plates 43 is three, and the number of process cartridges 17 is four.

Focusing on the first cartridge housing space 75*a*, the front beam 43*a* is positioned to face the front side surface 61*a* of the black process cartridge 17K, and the other beam plates 43 (rear beam 43*b* and center beam 43*c*) do not face the rear side surface 62*a* of the black process cartridge 17K.

Focusing on the second cartridge housing space 75*b*, the center beam 43*c* is positioned to face the rear side surface 62*b* of the yellow process cartridge 17Y, and the other beam plates 43 (front beam 43*a* and rear beam 43*b*) do not face the front side surface 61*b* of the yellow process cartridge 17Y.

Focusing on the third cartridge housing space 75*c*, the center beam 43*c* is positioned to face the front side surface 61*c* of the magenta process cartridge 17M, and the other beam plates 43 (front beam 43*a* and rear beam 43*b*) do not face the rear side surface 62*c* of the magenta process cartridge 17M.

Focusing on the fourth cartridge housing space 75*d*, the rear beam 43*b* is positioned to face the rear side surface 62*d* of the cyan process cartridge 17C, and the other beam plates 43 (front beam 43*a* and center beam 43*c*) do not face the front side surface 61*d* of the cyan process cartridge 17C.

Further, the front beam 43*a* is positioned to face the front side surface 61*a* of the black process cartridge 17K positioned frontmost in the front-rear direction, and the rear beam 43*b* is positioned to face the rear side surface 62*d* of the cyan process cartridge 17C positioned rearmost in the front-rear direction.

The center beam 43*c* is positioned to face the rear side surface 62*b* of the yellow process cartridge 17Y adjacent to the black process cartridge 17K positioned frontmost in the front-rear direction as well as to face the front side surface 61*c* of the magenta process cartridge 17M adjacent to the cyan process cartridge 17C positioned rearmost in the front-rear direction.

(3) Operational and Technical Advantages of the Drawer Unit of the First Embodiment (3-1) According to the printer 1 and drawer unit 12 of the first embodiment, the number of the beam plates 43 can be reduced when compared to a case where the beam plates 43 are positioned to face each of the front side surface 61 and rear surface side 62 of each process cartridge 17. Hence, reduced number of components are required, thereby resulting in reduction in production costs.

Further, each beam plate 43 is positioned to be spaced apart from the front side surface 61 or rear side surface 62 of each process cartridge 17. This structure permits deformation of the drawer frame to some extent.

As a result, the drawer frame 40 can have a relatively flexible structure in which deflection and distortion (twisting) are allowed to some extent at the outer position, while having a relatively rigid structure in which deflection and distortion (twisting) relative to the main casing 2 are restricted at the inner position.

Thus, when the drawer frame 40 is situated at the inner position, positioning of the photosensitive drum 18, charging roller 19, developing roller 20, supply roller 21, and thickness regulation blade 22 which are provided in each process cartridge 17 can be accurately performed relative to the main casing 2. As a result, enhanced image quality can be obtained in the printer 1.

(3-2) According to the printer 1 and drawer unit 12, any one of the beam plates 43 is positioned to face either the front side surface 61 or the rear side surface 62 of one process cartridge 17, thereby ensuring rigidity of the drawer frame 40.

(3-3) According to the printer 1 and drawer unit 12, the front beam 43*a* faces the front side surface 61(61*a*) of the black process cartridge 17K positioned frontmost in the front-rear direction, and the rear beam 43*b* faces the rear side surface 62(62*d*) of the cyan process cartridge 17C positioned rearmost in the front-rear direction.

Thus, rigidity of the drawer frame 40 can be ensured.

Further, the front side surface 61(61*a*) of the black process cartridge 17K and rear side surface 62(62*d*) of the cyan process cartridge 17C are respectively protected by the front beam 43*a* and rear beam 43*b*. Thus, damages to the process cartridge 17 can be suppressed.

(3-4) Further, according to the printer 1 and drawer unit 12, the center beam 43*c* is positioned to face the rear side surface 62*b* of the yellow process cartridge 17Y adjacent to the black process cartridge 17K positioned frontmost in the front-rear direction and also to face the front side surface 61*c* of the magenta process cartridge 17M adjacent to the cyan process cartridge 17C positioned rearmost in the front-rear direction. That is, the center beam 43*c* is positioned at a center of the drawer frame 40 in the front-rear direction and between the yellow process cartridge 17Y and magenta process cartridge 17M. Thus, rigidity of the drawer frame 40 can be ensured.

(3-5) According to the printer 1 and drawer unit 12, the left protruding plate 71 and right protruding plate 72 can guide mounting of the process cartridges 17 to their proper positions in the drawer frame 40. That is, even without the beam plates 43, the process cartridges 17 can be housed properly in the drawer unit 12 due to the guide by the left protruding plate 71 and right protruding plate 72.

Further, the left protruding plate 71 and right protruding plate 72 can restrict occurrence of backlash of the process cartridge 17 supported in the drawer frame 40 in the front-rear direction.

(3-6) According to the printer 1 and drawer unit 12, the front beam 43*a*, rear beam 43*b*, and center beam 43*c* have the same linear expansion coefficient. Thus, the front beam 43*a*, rear beam 43*b*, and center beam 43*c* can expand or contract substantially at the same rate as one another in length in response to a temperature change. Distortion of the beam plates 43 attributed to a temperature change can be restrained. As a result, deformation of the drawer frame 40 can be suppressed.

(3-7) According to the printer 1 and drawer unit 12, the front beam 43*a*, rear beam 43*b*, and center beam 43*c* are formed of the same resin material. Thus, rigidity of the front beam 43*a*, rear beam 43*b*, and center beam 43*c* can be made uniform, resulting in enhancement of rigidity of the drawer frame 40.

(3-8) According to the printer 1 and drawer unit 12, the left side plate 41 and right side plate 42 have the same linear expansion coefficient. Thus, the left side plate 41 and right side plate 42 expand or contract substantially at the same rate as each other in length in response to a temperature change. Distortion of the left and right side plates 41 and 42 attributed to a temperature change can therefore be suppressed.

(3-9) According to the printer 1 and drawer unit 12, the left side plate 41 and right side plate 42 are formed of the same resin material. Thus, rigidity of the left side plate 41 and right side plate 42 can be made uniform, resulting in enhancement of rigidity of the drawer frame 40.

(3-10) According to the printer 1 and drawer unit 12, the left side plate 41, right side plate 42, front beam 43*a*, rear beam 43*b*, and center beam 43*c* have the same linear expansion coefficient as one another. Thus, the left side plate 41, right side plate 42, front beam 43*a*, rear beam 43*b*, and center beam 43*c* can expand or contract substantially at the same rate as one another in length in response to a temperature change. Distortion attributed due to a temperature change can be suppressed.

This structure can also lead to reduction in occurrence of expansion or contraction between the left and right side plates 41, 42 and each beam plate 43 (front, rear, center beams 43*a*, 43*b*, 43*c*). As a result, backlash of the left and right side plates 41 and 42 relative to each beam plate 43 (front, rear, center beams 43*a*, 43*b*, 43*c*) can be suppressed.

3. Drawer Unit of the Second Embodiment

Figure 3:
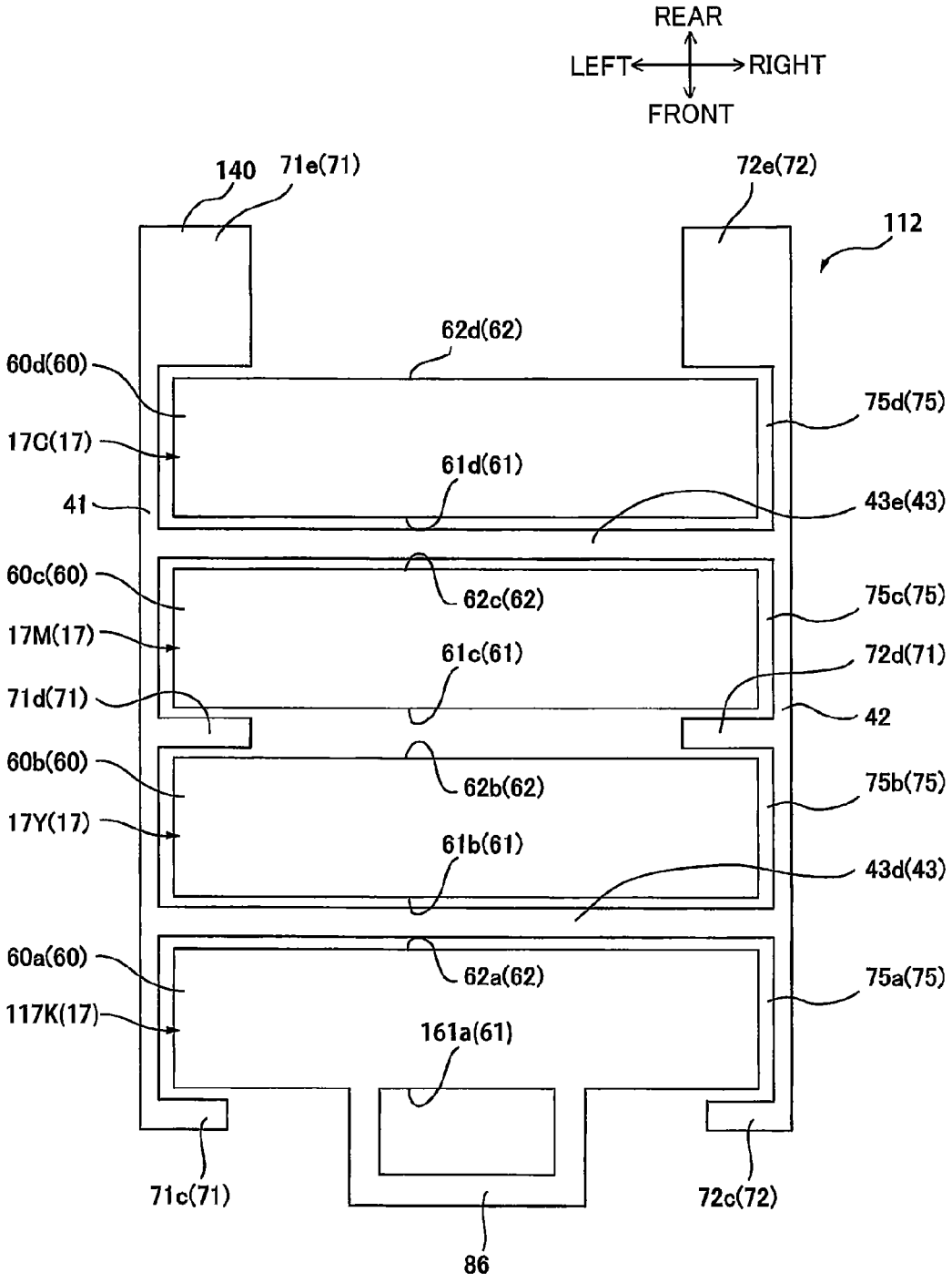
FIG. 3 is a plan view of a drawer unit according to a second embodiment of the present invention, the drawer unit including a front intermediate beam and a rear intermediate beam.

Next, detailed constructions of a drawer unit 112 according to a second embodiment of the present invention will be described with reference to FIG. 3. In the following description, like parts and components are designated by the same reference numerals with those of the first embodiment to avoid duplicating description.

In the drawer unit 12 of the first embodiment, the drawer frame 40 has the left side plate 41, right side plate 42, front beam 43*a*, rear beam 43*b*, and center beam 43*c*.

The drawer unit 112 of the second embodiment has a drawer frame 140 configured of the left side plate 41, the right side plate 42, a front intermediate beam 43*d* and a rear intermediate beam 43*e*.

Specifically, the left side plate 41 of the second embodiment has a front-left end protruding plate 71*c*, a center-left protruding plate 71*d*, and a rear-left end protruding plate 71*e*, as the left protruding plates 71. The front-left end protruding plate 71*c* protrudes rightward from a front end portion of the left side plate 41. The center-left protruding plate 71*d* protrudes rightward from a center portion of the left side plate 41. The rear-left end protruding plate 71*e* protrudes rightward from a rear end portion of the left side plate 41. The rear-left end protruding plate 71*e* has a thickness larger than that of the front-left end protruding plate 71*c* in the front-rear direction.

The right side plate 42 of the second embodiment has a front-right end protruding plate 72*c*, a center-right protruding plate 72*d*, and a rear-right end protruding plate 72*e*, as the right protruding plate 72. The front-right end protruding plate 72*c* protrudes leftward from a front end portion of the right side plate 42. The center-right protruding plate 72*d* protrudes leftward from a center portion of the right side plate 42. The rear-right end protruding plate 72*e* protrudes leftward from a rear end portion of the right side plate 42. The rear-right end protruding plate 72*e* has a thickness larger than that of the front right end protruding plate 72*c* in the front-rear direction.

The front-left end protruding plate 71*c* and front-right end protruding plate 72*c* are positioned to be aligned with each other in the left-right direction. Similarly, the center-left protruding plate 71*d* and center-right protruding plate 72*d* are positioned to be aligned with each other in the left-right direction, and the rear-left end protruding plate 71*e* and rear-right end protruding plate 72*e* are positioned to be aligned with each other in the left-right direction.

The front intermediate beam 43*d* is a flat plate having a substantially rectangular shape extending in the left-right direction in a front view. The front intermediate beam 43*d* connects the respective front intermediate positions of the left side plate 41 and right side plate 42, each front intermediate position being positioned between the front end portion and the center portion of the left side plate 41 or the right side plate 42.

The rear intermediate beam 43*e* is a flat plate having a substantially rectangular shape extending in the left-right direction in a front view. The rear intermediate beam 43*e* connects the respective rear intermediate positions of the left side plate 41 and right side plate 42, each rear intermediate position being positioned between the rear end portion and the center portion of the left side plate 41 or the right side plate 42.

The front intermediate beam 43*d*, front-left end and front-right end protruding plates 71*c* and 72*c*, and left and right side plates 41 and 42 between the front-left end and front-right end protruding plates 71*c* and 72*c* define the first cartridge housing space 75*a* extending in the left-right direction. The first cartridge housing space 75*a* is positioned frontmost in the front-rear direction among the four cartridge housing spaces 75, as in the first embodiment. The first cartridge housing space 75*a* houses a black process cartridge 117K of the second embodiment, instead of the black process cartridge 17K. The black process cartridge 117K has a front surface 161*a* and a gripping part 86 formed on the front surface 161*a* at a center thereof in the left-right direction to protrude frontward therefrom.

The front intermediate beam 43*d*, center-left and center-right protruding plates 71*d* and 72*d*, and left and right side plates 41 and 42 between the center-left and center-right protruding plates 71*d* and 72*d* define the second cartridge housing space 75*b* extending in the left-right direction. The second cartridge housing space 75*b* is positioned second from the front in the front-rear direction among the four cartridge housing spaces 75. The second cartridge housing space 75*b* houses the yellow process cartridge 17Y.

The rear intermediate beam 43*e*, center-left and center-right protruding plates 71*d* and 72*d*, and left and right side plates 41 and 42 between the center-left and center-right protruding plates 71*d* and 72*d* define the third cartridge housing space 75*c* extending in the left-right direction. The third cartridge housing space 75*c* is positioned second from the rear in the front-rear direction among the four cartridge housing spaces 75. The third cartridge housing space 75*c* houses the magenta process cartridge 17M.

The rear intermediate beam 43*e*, rear-left end and rear-right end protruding plates 71*e* and 72*e*, and left and right side plates 41 and 42 between the rear-left end and rear-right end protruding plates 71*e* and 72*e* define the fourth cartridge housing space 75*d* extending in the left-right direction. The fourth cartridge housing space 75*d* is positioned rearmost among the four cartridge housing spaces 75 in the front-rear direction. The fourth cartridge housing space 75*d* houses the cyan process cartridge 17C.

Focusing on the first cartridge housing space 75*a*, the front intermediate beam 43*d* is positioned to face the rear side surface 62*a* of the black process cartridge 117K, and the other beam plate 43 (rear intermediate beam 43*e*) does not face the front side surface 161*a* of the black process cartridge 117K.

Focusing on the second cartridge housing space 75*b*, the front intermediate beam 43*d* is positioned to face the front side surface 61*b* of the yellow process cartridge 17Y, and the other beam plate 43 (rear intermediate beam 43*e*) does not face the rear side surface 62*b* of the yellow process cartridge 17Y.

Focusing on the third cartridge housing space 75*c*, the rear intermediate beam 43*e* is positioned to face the rear side surface 62*c* of the magenta process cartridge 17M, and the other beam plate 43 (front intermediate beam 43*d*) does not face the front side surface 61*c* of the magenta process cartridge 17M.

Focusing on the fourth cartridge housing space 75*d*, the rear intermediate beam 43*e* is positioned to face the front side surface 61*d* of the cyan process cartridge 17C, and the other beam plate 43 (front intermediate beam 43*d*) do not face the rear side surface 62*d* of the cyan process cartridge 17C.

According to the drawer unit 112 of the second embodiment, any one of the beam plates 43 (front intermediate beam 43*d* or rear intermediate beam 43*e*) is positioned to face the front side surface 61 or rear side surface 62 of one process cartridge 17. Rigidity of the drawer frame 140 can be thus ensured. Further, the drawer frame 140 and process cartridges 17 supported by the drawer frame 140 can be reliably moved between the inner position (at which the drawer unit 112 is positioned inside the main casing 2) and outer position (at which the drawer unit 112 is positioned outside the main casing 2) by holding the holding part 86 of the black process cartridge 117K.

4. Drawer Unit of the Third Embodiment

Next, detailed constructions of a drawer frame 240A-240C according to a third embodiment of the present invention will be described with reference to FIGS. 4A to 4C. In the following description, like parts and components are designated by the same reference numerals with those of the forgoing embodiments to avoid duplicating description.

The drawer frame 40 of the first embodiment has three beam plates 43 (front beam 43*a*, rear beam 43*b* and center beam 43*c*). However, the number of beam plates 43 is not necessarily limited to three, as long as the number of beam plates 43 is equal to or smaller than the number of process cartridges 17 provided in the drawer frame 40.

Figure 4A:
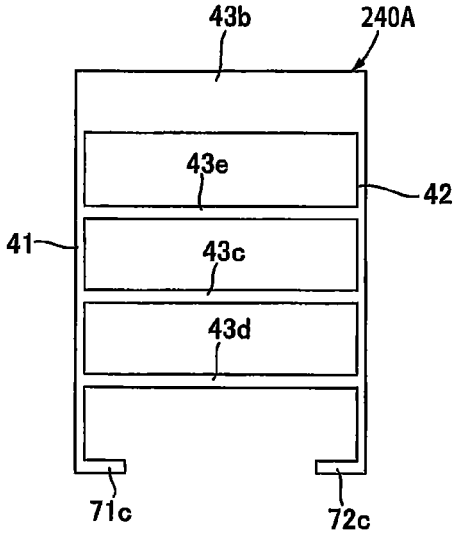
FIG. 4A is a plan view of a drawer frame of a drawer unit according to a third embodiment of the present invention, the drawer frame including the front intermediate beam, the center beam, the rear intermediate beam and the rear beam.
Figure 4B:
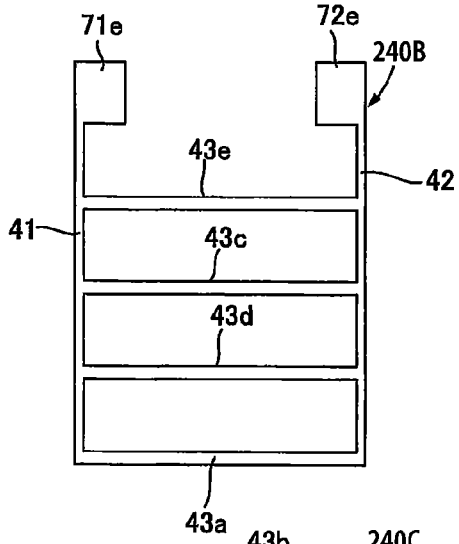
FIG. 4B is a plan view of another example of the drawer frame of the drawer unit according to the third embodiment, the drawer frame including the front beam, the front intermediate beam, the center beam and the rear intermediate beam.
Figure 4C:
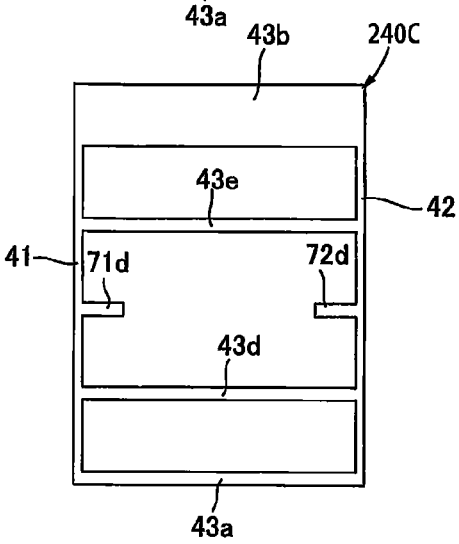
FIG. 4C is a plan view of still another example of the drawer frame of the drawer unit according to the third embodiment, the drawer frame including the front beam, the front intermediate beam, the rear intermediate beam and the rear beam.

As an example, in the third embodiment, each drawer frame 240A-240C has four beam plates 43, as illustrated in FIGS. 4A to 4C.

Referring to FIG. 4A, in the drawer frame 240A, the front intermediate beam 43*d*, center beam 43*c*, rear intermediate beam 43*e*, and rear beam 43*b* are provided to connect between the left side plate 41 and right side plate 42.

In the drawer frame 240A, the left side plate 41 has the front-left end protruding plate 71*c*, and the right side plate 42 has the front-right end protruding plate 72*c*.

Referring to FIG. 4B, in the drawer frame 240B, the front beam 43*a*, front intermediate beam 43*d*, center beam 43*c*, and rear intermediate beam 43*e* are provided to connect between the left side plate 41 and right side plate 42. In FIG. 4B, the gripping part 46 is omitted.

In the drawer frame 240B, the left side plate 41 has the rear-left end protruding plate 71*e*, and the right side plate 42 has the rear-right end protruding plate 72*e*.

Referring to FIG. 4C, in the drawer frame 240C, the front beam 43*a*, front intermediate beam 43*d*, rear intermediate beam 43*e*, and rear beam 43*b* are provided to connect between the left side plate 41 and right side plate 42. In FIG. 4C, the gripping part 46 is omitted.

In the drawer frame 240C, the left side plate 41 has the center-left protruding plate 71*d*, and the right side plate 42 has the center-right protruding plate 72*d*.

5. Drawer Unit of the Fourth Embodiment

Next, detailed constructions of a drawer frame 340A-340G according to a fourth embodiment of the present invention will be described with reference to FIGS. 5A to 5G. In the following description, like parts and components are designated by the same reference numerals with those of the forgoing embodiments to avoid duplicating description.

The drawer frame 340A-340G of the fourth embodiment includes three beam plates 43 or less than three less beam plates 43.

Figure 5A:
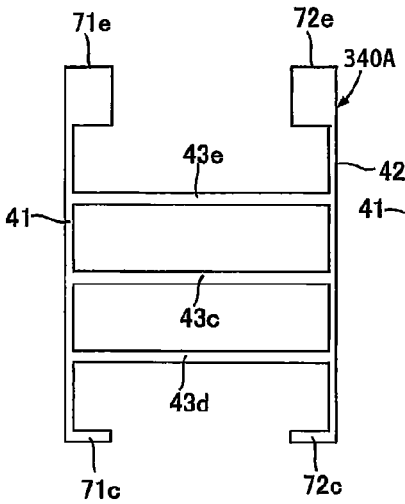
FIG. 5A is a plan view of a first example of a drawer frame of a drawer unit according to a fourth embodiment of the present invention, the drawer frame including three beam plates, i.e., the front intermediate beam, the center beam and the rear intermediate beam.

In the drawer frame 340A illustrated in FIG. 5A, three beam plates 43 (i.e., the front intermediate beam 43*d*, center beam 43*c*, and rear intermediate beam 43*e*) connect the left side plate 41 and right side plate 42.

In the drawer frame 340A, the left side plate 41 has the front-left end protruding plate 71*c* and rear-left end protruding plate 71*e*, and the right side plate 42 has the front-right end protruding plate 72*c* and rear-right end protruding plate 72*e*.

Figure 5D:
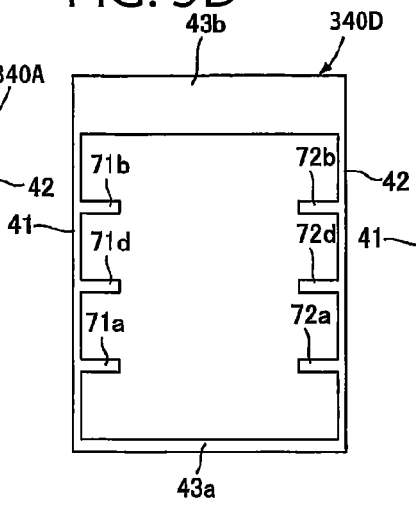
FIG. 5D is a plan view of a fourth example of the drawer frame of the drawer unit according to the fourth embodiment, the drawer frame including two beam plates, i.e., the front beam and the rear beam.
Figure 5G:
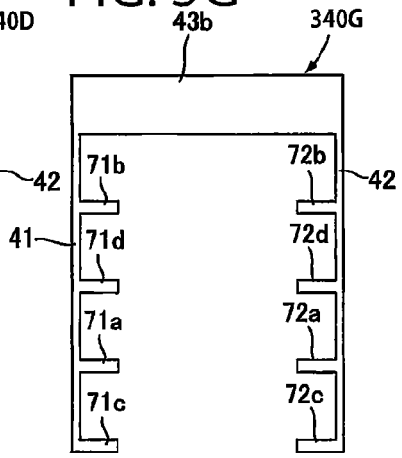
FIG. 5G is a plan view of a seventh example of the drawer frame of the drawer unit according to the fourth embodiment, the drawer frame including only one beam plate, i.e., the rear beam.
Figure 5B:
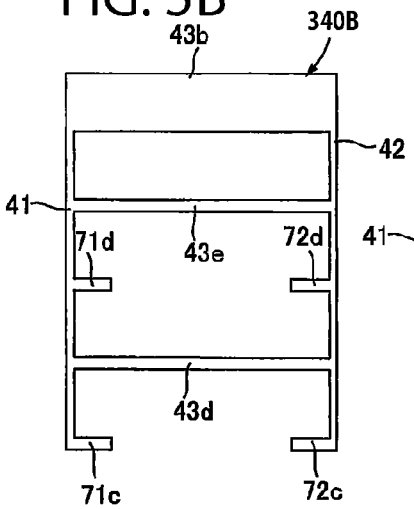
FIG. 5B is a plan view of a second example of the drawer frame of the drawer unit according to the fourth embodiment, the drawer frame including three beam plates, i.e., the front intermediate beam, the rear intermediate beam and the rear beam.

In the drawer frame 340B illustrated in FIG. 5B, three beam plates 43 (i.e., the front intermediate beam 43*d*, rear intermediate beam 43*e*, and rear beam 43*b*) connect the left side plate 41 and right side plate 42.

In the drawer frame 340B, the left side plate 41 has the front-left end protruding plate 71*c* and center-left protruding plate 71*d*, and the right side plate 42 has the front-right end protruding plate 72*c* and center-right protruding plate 72*d*.

Figure 5E:
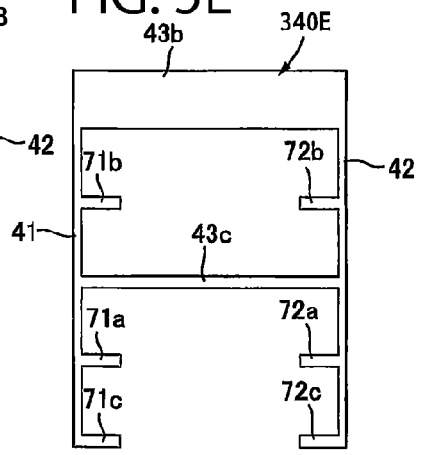
FIG. 5E is a plan view of a fifth example of the drawer frame of the drawer unit according to the fourth embodiment, the drawer frame including two beam plates, i.e., the center beam and the rear beam.
Figure 5C:
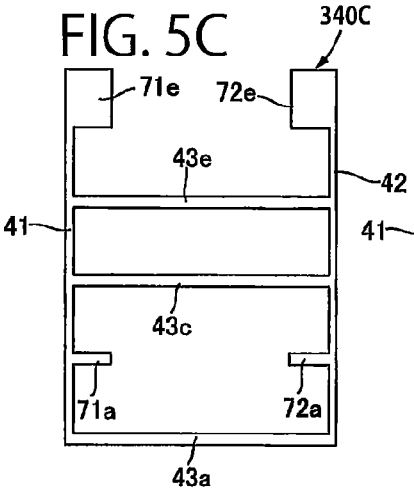
FIG. 5C is a plan view of a third example of the drawer frame of the drawer unit according to the fourth embodiment, the drawer frame including three beam plates, i.e., the front beam, the center beam and the rear intermediate beam.

In the drawer frame 340C illustrated in FIG. 5C, three beam plates 43 (i.e., the front beam 43*a*, center beam 43*c*, and rear intermediate beam 43*e*) connect the left side plate 41 and right side plate 42. In FIG. 5C, the gripping part 46 is omitted.

In the drawer frame 340C, the left side plate 41 has the front-left intermediate protruding plate 71*a* and rear-left end protruding plate 71*e*, and the right side plate 42 has the front-right intermediate protruding plate 72*a* and rear-right end protruding plate 72*e*.

In the drawer frame 340D illustrated in FIG. 5D, two beam plates 43 (i.e., the front beam 43*a* and rear beam 43*b*) connect the left side plate 41 and right side plate 42. In FIG. 5D, the gripping part 46 is omitted.

In the drawer frame 340D, the left side plate 41 has the front-left intermediate protruding plate 71*a*, center-left protruding plate 71*d*, and rear-left intermediate protruding plate 71*b*, and the right side plate 42 has the front-right intermediate protruding plate 72*a*, center-right protruding plate 72*d*, and rear-right intermediate protruding plate 72*b*.

In the drawer frame 340E illustrated in FIG. 5E, two beam plates 43 (i.e., the center beam 43*c* and rear beam 43*b*) connect the left side plate 41 and right side plate 42.

In the drawer frame 340E, the left side plate 41 has the front-left end protruding plate 71*c*, front-left intermediate protruding plate 71*a* and rear-left intermediate protruding plate 71*b*, and the right side plate 42 has the front-right end protruding plate 72*c*, front-right intermediate protruding plate 72*a* and rear-right intermediate protruding plate 72*b*.

Figure 5F:
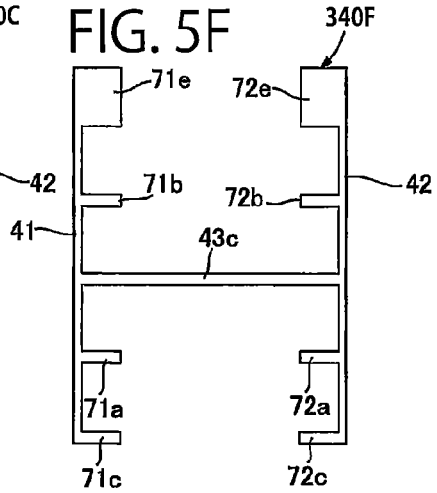
FIG. 5F is a plan view of a sixth example of the drawer frame of the drawer unit according to the fourth embodiment, the drawer frame including only one beam plate, i.e., the center beam.

In the drawer frame 340F illustrated in FIG. 5F, one beam plate 43 (i.e., the center beam 43*c*) connects the left side plate 41 and right side plate 42.

In the drawer frame 340F, the left side plate 41 has the front-left end protruding plate 71*c*, front-left intermediate protruding plate 71*a*, rear-left intermediate protruding plate 71*b*, and rear-left end protruding plate 71*e*, and the right side plate 42 has the front-right end protruding plate 72*c*, front-right intermediate protruding plate 72*a*, rear-right intermediate protruding plate 72*b*, and rear-right end protruding plate 72*e*.

In the drawer frame 340G illustrated in FIG. 5G, one beam plate 43 (i.e., the rear beam 43*b*) connects the left side plate 41 and right side plate 42.

In the drawer frame 340G, the left side plate 41 has the front-left end protruding plate 71*c*, front-left intermediate protruding plate 71*a*, center-left protruding plate 71*d*, and rear-left intermediate protruding plate 71*b*, and the right side plate 42 has the front-right end protruding plate 72*c*, front-right intermediate protruding plate 72*a*, center-right protruding plate 72*d*, and rear-right intermediate protruding plate 72*b*.

6. Drawer Unit of the Fifth Embodiment

Figure 6:
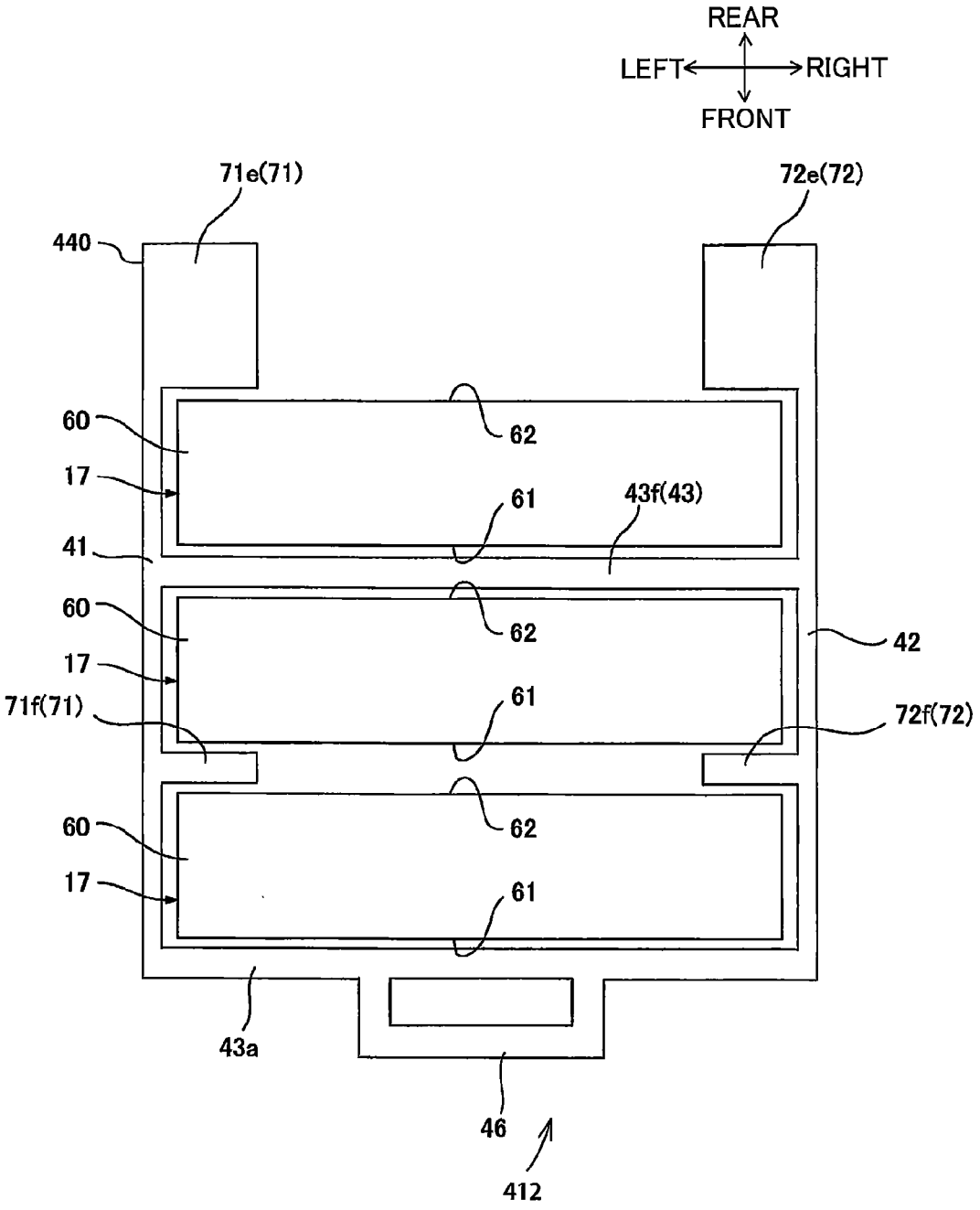
FIG. 6 is a plan view of a drawer unit according to a fifth embodiment of the present invention, wherein the drawer unit including three process cartridges.

Next, detailed constructions of a drawer unit 412 (having a drawer frame 440) according to a fifth embodiment of the present invention will be described with reference to FIG. 6. In the following description, like parts and components are designated by the same reference numerals with those of the forgoing embodiments to avoid duplicating description.

The drawer unit 12 of the first embodiment includes four process cartridges 17. However, the number of process cartridges 17 may be fewer than four. As an example, the drawer unit 412 of the fifth embodiment includes three process cartridges 17 instead of four process cartridges 17, as shown in FIG. 6.

Specifically, the drawer frame 412 has the left side plate 41, right side plate 42, front beam 43*a*, and an intermediate beam 43*f*.

Further, the left side plate 41 has an intermediate-left protruding plate 71*f* and the rear-left end protruding plate 71*e*. The intermediate-left protruding plate 71*f* protrudes rightward from a right surface of the left side plate 41 at a position substantially one-third of the left side plate 41 from the front end thereof in the front-rear direction.

The right side plate 42 has an intermediate-right protruding plate 72*f* and the rear-right end protruding plate 72*e*. The intermediate-right protruding plate 72*f* protrudes leftward from a left surface of the right side plate 42 at a position substantially one-third of the right side plate 42 the front end portion thereof in the front-rear direction.

The intermediate beam 43*f* connects between a general center of the left side plate 41 and a general center of the right side plate 42 in the front-rear direction, the general center of the left side plate 41 being a general center between the intermediate-left protruding plate 71*f* and the rear-left end protruding plate 71*e* and the general center of the right side plate 42 being a general center between the intermediate-right protruding plate 72*f* and the rear-right end protruding plate 72*e* in the front-rear direction.

7. Drawer Unit of the Sixth Embodiment

Next, detailed constructions of a drawer frame 540 according to a sixth embodiment of the present invention will be described with reference to FIGS. 7A and 7B. In the following description, like parts and components are designated by the same reference numerals with those of the forgoing embodiments to avoid duplicating description.

Figure 7A:
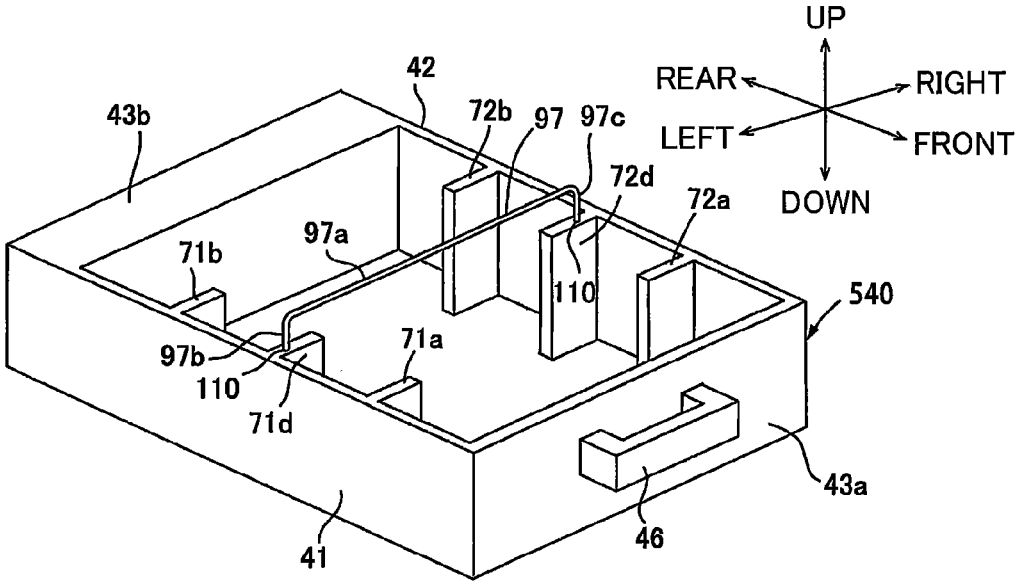
FIG. 7A is a perspective view of a drawer frame of a drawer unit according to a sixth embodiment of the present invention, the drawer frame including a bar steel member.

As illustrated in FIG. 7A, the drawer frame 540 according to the sixth embodiment is generally identical to the drawer frame 340D illustrated in FIG. 5D, but drawer frame 540 is further provided with a bar steel member 7171.

That is, the drawer frame 540 includes the left side plate 41, right side plate 42, the front beam 43*a* and rear beam 43*b*. The front beam 43*a* and rear beam 43*b* connect between the left side plate 41 and right side plate 42. The left side plate 41 has the front-left intermediate protruding plate 71*a*, center-left protruding plate 71*d*, and rear-left intermediate protruding plate 71*b*, and the right side plate 42 has the front-right intermediate protruding plate 72*a*, center-right protruding plate 72*d*, and rear-right intermediate protruding plate 72*b*.

Further, each of the center-left protruding plate 71*d* and center-right protruding plate 72*d* is formed with an engagement groove 110. The engagement grooves 110 are in a form of a bored hole recessed into an upper end face of the center-left protruding plate 71*d* and upper end face of the center-right protruding plate 72*d*, respectively.

Figure 7B:
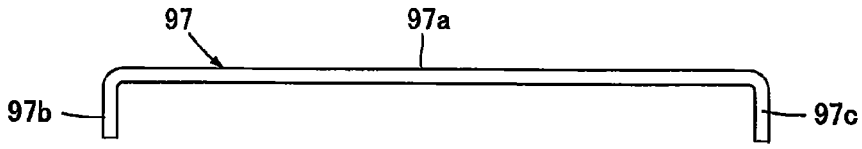
FIG. 7B is a front view of the bar steel member of the sixth embodiment.

As illustrated in FIG. 7B, the bar steel member 97 is formed of a bar-like shaped steel extending in the left-right direction. The bar steel member 97 has a length (thickness) smaller than the beam plates 43 (front beam 43*a* and rear beam 43*b*) with respect to the front-rear direction. More specifically, the bar steel member 97 has a substantial U-shape and includes a body portion 97*a*, a left engagement portion 97*b*, and a right engagement portion 97*c*.

The body portion 97*a* has a round bar shape extending in the left-right direction and has a length spanning between the center-left protruding plate 71*d* and the center-right protruding plate 72*d* in the left-right direction.

The left engagement portion 97*b* has a round bar shape and extends downward from a left end portion of the body part 97*a*. The right engagement portion 97*c* has a round bar shape and extends downward from a right end portion of the body part 97*a*.

As illustrated in FIG. 7A, the left engagement portion 97*b* is engaged with the engagement groove 110 of the center-left protruding plate 71*d*, and the right engagement portion 97*c* is engaged with the engagement groove 110 of the center-right protruding plate 72*d*.

With this configuration, although the drawer frame 540 is not provided with the center beam 43*c*, the bar steel member 97 in place of the center beam 43*c* can restrict a left-right distance between the left side plate 41 and right side plate 42 from getting longer than a left-right distance that could have been maintained if the center beam 43*c* connects between the left side plate 41 and right side plate 42.

In other words, the left-right distance between the left side plate 41 and right side plate 42 is suppressed from becoming longer by the bar steel member 97. The left-right distance between the left side plate 41 and right side plate 42 can be thus properly maintained.

As a result, when the process cartridges 17 are mounted in the drawer frame 540, distances between each process cartridges 17 and each side plate (the left and right side plates 41, 42) is maintained as prescribed, thereby suppressing backlash of the process cartridges 17 relative to the left and right side plates 41 and 42.

The bar steel member 97 is engaged with the center-left protruding plate 71*d* and center-right protruding plate 72*d* in the sixth embodiment, but the bar steel member 97 may be engaged with any one of pairs of the left protruding plates 71 and right protruding plates 72 depending on an intended use.

For example, the bar steel member 97 may be engaged with the pair of the front-left intermediate protruding plate 71*a* and front-right intermediate protruding plate 72*a* or the pair of rear-left intermediate protruding plate 71*b* and rear-right intermediate protruding plate 72*b*.

8. Drawer Unit of the Seventh Embodiment

Figure 8:
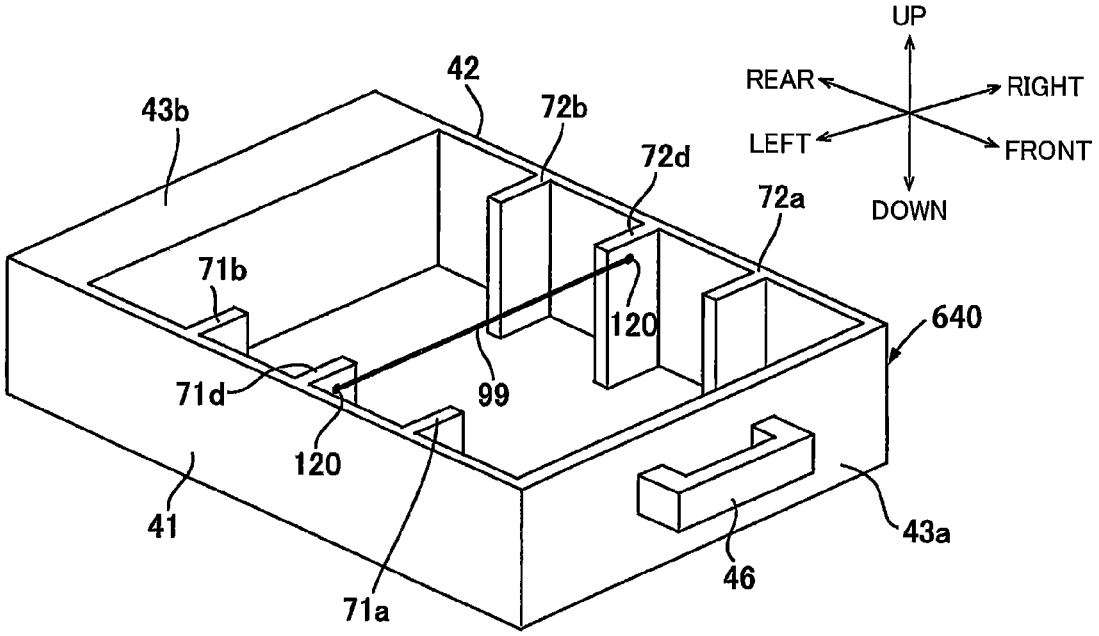
FIG. 8 is a perspective view of a drawer frame of a drawer unit according to a seventh embodiment of the present invention, the drawer frame including a wire rod.

A drawer frame 640 according to a seventh embodiment of the present invention will be described with reference to FIG. 8.

The drawer frame 640 of the seventh embodiment has the same structure as the drawer frame 540 of the sixth embodiment except the 97 except the bar steel member 97. That is, in the drawer frame 640, a wire rod 99 is provided instead of the bar steel member 97. In the drawer frame 640, the wire rod 99 is engaged with the center-left protruding plate 71*d* and center-right protruding plate 72*d*.

Specifically, each of the center-left protruding plate 71*d* and center-right protruding plate 72*d* has an engagement portion 120. The engagement portions 120 are formed in a front surface of the center-left protruding plate 71*d* and a front surface of the center-right protruding plate 72*d*, respectively.

The wire rod 99 is formed of a wire extending in the left-right direction and has a length spanning between the center-left protruding plate 71*d* and center-right protruding plate 72*d*.

A left end portion of the wire rod 99 is engaged with the engagement portion 120 of the center-left protruding plate 71*d*, and a right end portion of the wire rod 99 is engaged with the engagement portion 120 of the center-right protruding plate 72*d*.

Providing the wire rod 99 in the drawer frame 640 can be simple and easy. At the same time, the same technical advantages as those of the sixth embodiment can be achieved.

Incidentally, the wire rod 99 may be engaged with any one of pairs of the left protruding plates 71 and right protruding plates 72, depending on an intended use.

For example, the wire rod 99 may be engaged with the pair of the front-left intermediate protruding plate 71*a* and front-right intermediate protruding plate 72*a* or the pair of rear-left intermediate protruding plate 71*b* and rear-right intermediate protruding plate 72*b*.

9. Drawer Unit of the Eighth Embodiment

A drawer frame 740 according to an eighth embodiment will be described next with reference to FIG. 9. In the following description, like parts and components are designated by the same reference numerals with those of the first embodiment to avoid duplicating description In the drawer unit 12 of the first embodiment, the left side plate 41, right side plate 42, and three beam plates 43 integrally constitute the drawer frame 40 as a single member.

Figure 9:
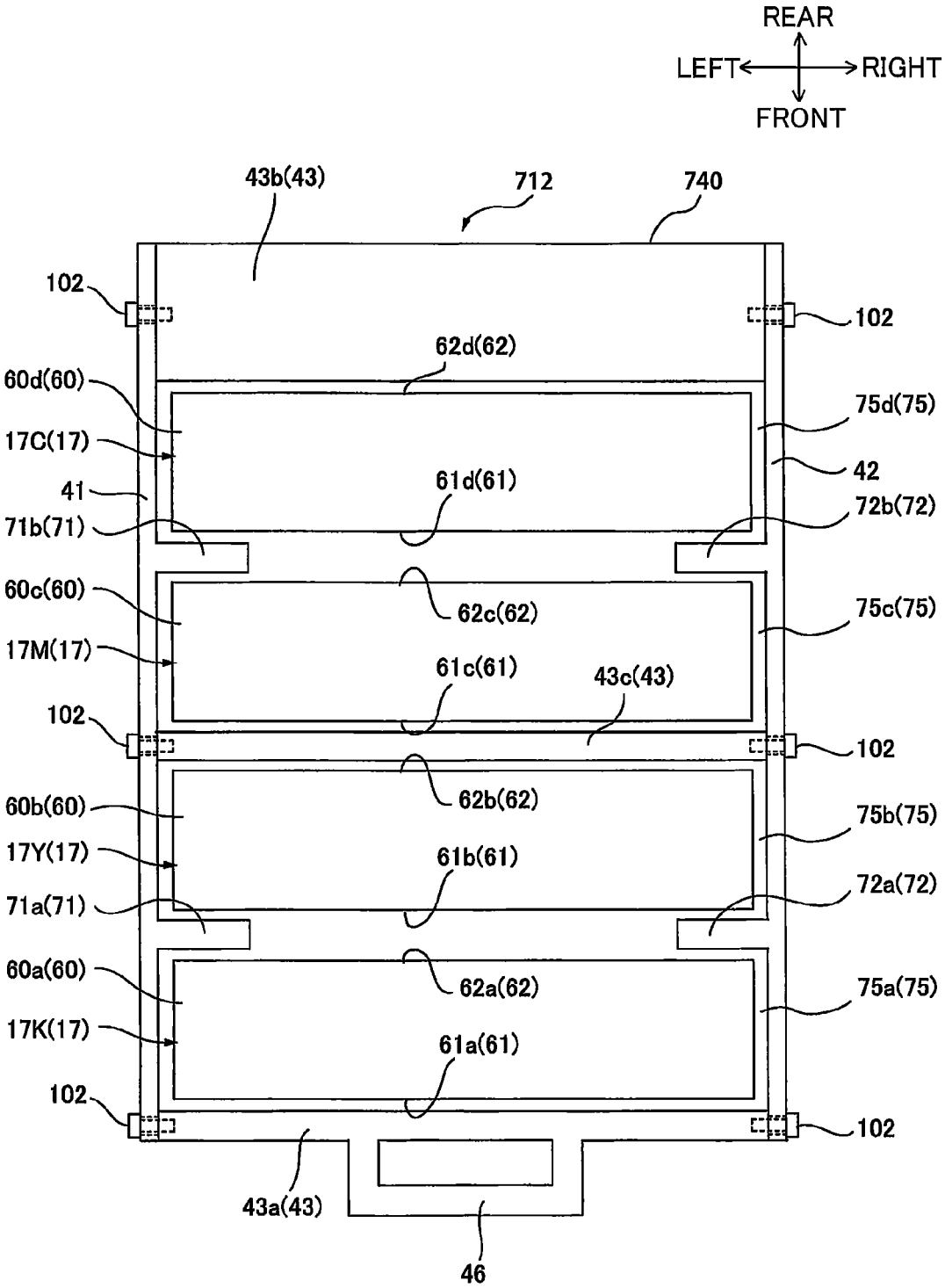
FIG. 9 is a plan view of a drawer unit according to an eighth embodiment of the present invention, the drawer unit including a drawer frame including three beam plates each screw-fixed to each of left and right side plates.

However, as illustrated in FIG. 9, in the drawer frame 740 according to an eighth embodiment, the left side plate 41, right side plate 42, and three beam plates 43 are formed as separate members and constitute the drawer frame 40 when assembled to one another.

Specifically, in a drawer unit 712 of the eighth embodiment, the drawer frame 740 has the left side plate 41, right side plate 42, and three beam plates 43 (front beam 43*a*, rear beam 43*b* and center beam 43*c*) each as an independent member.

Each of the three beam plates 43 is screw-fixed to the left side plate 41 and right side plate 42 by screws 102.

The drawer unit 712 as assembled above can also achieve the same operational and technical advantages as those of the drawer unit 12 of the first embodiment.

10. Variations and Modifications

In the depicted embodiments, the left side plate 41, right side plate 42, and beam plates 43 are formed of the same resin material. However, the beam plates 43 may be made of a material different from those of the left side plate 41 and right side plate 42. For example, the left and right side plates 41, 42 may be formed of a resin, while the beam plates 43 may be made of a metal steel plate.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main casing;

a plurality of cartridges each extending in a first direction substantially perpendicular to a vertical direction and each accommodating developer; and a supporting member configured to detachably support the plurality of cartridges such that the cartridges are arrayed in a second direction substantially perpendicular to the vertical direction and the first direction, the supporting member being movable between an inner position disposed within the main casing and an outer position disposed outside of the main casing, the supporting member comprising:

a first side plate, the first side plate having:

a first main portion extending in the second direction and in the vertical direction, the first main portion having a bottom end portion in the vertical direction;

a first supporting portion protruding inward in the first direction from the bottom end portion of the first main portion, the first supporting portion being configured to support the plurality of cartridges; and a first protruding portion protruding inward from the first main portion in the first direction, the first protruding portion having a length in the second direction shorter than a length of the first main portion in the second direction;

a second side plate positioned opposite to and spaced away from the first side plate in the first direction, the second side plate having:

a second main portion extending in the second direction and in the vertical direction, the second main portion having a bottom end portion in the vertical direction;

a second supporting portion protruding inward in the first direction from the bottom end portion of the second main portion, the second supporting portion being configured to support the plurality of cartridges; and a second protruding portion protruding inward from the second main portion in the first direction, the second protruding portion having a length shorter than a length of the second main portion in the second direction, the first protruding portion and the second protruding portion defining a gap therebetween in the first direction; and a prescribed number of beam plates extending between and connecting the first side plate and the second side plate, the prescribed number being in a range of one to not more than a number of the cartridges.

2. The image forming apparatus as recited in claim 1, wherein the prescribed number is not less than two;

wherein each of the plurality of cartridges has a first end surface and a second end surface opposite to each other in the second direction, the first end surface and the second end surface extending in the first direction; and wherein each of the prescribed number of beam plates is positioned not to face one of the first end surface and the second end surface of each cartridge in the second direction.

3. The image forming apparatus as recited in claim 2, wherein the plurality of cartridges includes a first cartridge;

wherein one of the prescribed number of beam plates is positioned to face the first end surface of the first cartridge in the second direction; and wherein remaining ones of the prescribed number of beam plates are positioned not to oppose the second end surface of the first cartridge in the second direction.

4. The image forming apparatus as recited in claim 2, wherein the plurality of cartridges includes a first cartridge positioned at a first outermost end in the second direction and a second cartridge positioned at a second outermost end in the second direction;

wherein one of the prescribed number of beam plates is positioned to face the first end surface of the first cartridge in the second direction; and wherein another one of the prescribed number of beam plates is positioned to face the second end surface of the second cartridge in the second direction.

5. The image forming apparatus as recited in claim 2, wherein the plurality of cartridges includes a first cartridge positioned at one end in the second direction and a third cartridge positioned adjacent to the first cartridge in the second direction; and wherein one of the prescribed number of beam plates is positioned to face the second end surface of the third cartridge.

6. The image forming apparatus as recited in claim 2, wherein the plurality of cartridges includes a first cartridge positioned at a first outermost end in the second direction and a second cartridge positioned at a second outermost end in the second direction;

wherein the prescribed number of beam plates are positioned not to face the first end surface of the first cartridge and not to face the second end surface of the second cartridge in the second direction; and wherein the first cartridge is provided with a gripping part protruding from the first end surface of the first cartridge in a direction away from the second end surface of the first cartridge in the second direction.

7. The image forming apparatus as recited in claim 6, wherein each of the first protruding portion and the second protruding portion has a protruding end positioned midway between the first side plate and the second side plate in the first direction, and the first protruding portion and the second protruding portion being aligned with each other in the first direction.

8. The image forming apparatus as recited in claim 2, wherein the supporting member further includes a restricting member extending in the first direction and having a thickness smaller than each of the prescribed number of beam plates in the second direction, the restricting member having a first end and a second end opposite to each other in the first direction, the first end being engaged with the first side plate and the second end being engaged with the second side plate.

9. The image forming apparatus as recited in claim 8, wherein a distance between the first side plate and the second side plate connected by the prescribed number of beam plates in the first direction is defined as a predetermined distance, the restricting member being configured to restrict a distance between the first side plate and the second side plate engaged with the restricting member from becoming larger than the predetermined distance in the first direction.

10. The image forming apparatus as claimed in claim 9, wherein the restricting member comprises a wire grid.

11. The image forming apparatus as claimed in claim 9, wherein the restricting member comprises a bar-like shaped steel member.

12. The image forming apparatus as claimed in claim 2, wherein the first protruding portion is configured to guide attachment and detachment of one of the cartridges relative to the supporting member, the first protruding portion having a first protruding end positioned midway between the first side plate and the second side plate in the first direction.

13. The image forming apparatus as claimed in claim 12, wherein the second protruding portion is configured to guide attachment and detachment of one of the cartridges relative to the supporting member, the second protruding portion having a second protruding end positioned midway between the first side plate and the second side plate in the first direction; and wherein the first protruding portion and the second protruding portion are aligned with each other in the first direction.

14. The image forming apparatus as claimed in claim 2, wherein the prescribed number of beam plates have substantially the same linear expansion coefficient as one another.

15. The image forming apparatus as claimed in claim 14, wherein the prescribed number of beam plates are made of substantially the same material as one another.

16. The image forming apparatus as claimed in claim 2, wherein the first side plate and the second side plate have substantially the same linear expansion coefficient as each other.

17. The image forming apparatus as claimed in claim 16, wherein the first side plate and the second side plate are made of substantially the same material as each other.

18. The image forming apparatus as claimed in claim 2, wherein the prescribed number of beam plates, the first side plate and the second side plate have substantially the same linear expansion coefficient as one another.

19. An image forming apparatus comprising:

a main casing;

a drawer being movable in a first direction between an inner position disposed within the main casing and an outer position disposed outside of the main casing; and a plurality of cartridges each accommodating developer and configured to be detachable and attachable relative to the drawer;

wherein the drawer comprises:

a first side wall;

a second side wall disposed at a position opposite to the first side wall with respect to the plurality of cartridges in a second direction perpendicular to the first direction; and a prescribed number of beam plates extending between and connecting the first side wall and the second side wall, the prescribed number being in a range of one to not more than a number of the cartridges, wherein the first side wall includes:

a first main portion extending in the first direction and in a third direction perpendicular to the first direction and the second direction, the first main portion having a bottom end portion in the third direction;

a first supporting portion protruding inward in the second direction from the bottom end portion of the first main portion, the first supporting portion being configured to support the plurality of cartridges; and a first protruding portion protruding inward from the first main portion in the second direction, the first protruding portion having a length shorter than a length of the first main portion in the first direction, and wherein the second side wall includes:

a second main portion extending in the first direction and in the third direction, the second main portion having a bottom end portion in the third direction;

a second supporting portion protruding inward in the second direction from the bottom end portion of the second main portion, the second supporting portion being configured to support the plurality of cartridges; and a second protruding portion protruding inward from the second main portion in the second direction, the second protruding portion having a length shorter than a length of the second main portion in the first direction, the first protruding portion and the second protruding portion defining a gap therebetween in the second direction.

* * * * *